US006903623B2

(12) United States Patent
Jain

(10) Patent No.: US 6,903,623 B2
(45) Date of Patent: Jun. 7, 2005

(54) HIGH ISOLATION SWITCH IN BALANCED LINES

(75) Inventor: Nitin Jain, San Diego, CA (US)

(73) Assignee: Anokiwave, Inc., San Diego, CA (US)

( * ) Notice: Subject to any disclaimer, the term of this patent is extended or adjusted under 35 U.S.C. 154(b) by 51 days.

(21) Appl. No.: 10/458,538

(22) Filed: Jun. 9, 2003

(65) Prior Publication Data

US 2004/0246067 A1 Dec. 9, 2004

(51) Int. Cl.[7] ..... H01P 5/12
(52) U.S. Cl. ..... 333/103; 333/104; 333/262
(58) Field of Search ..... 333/101, 103, 333/104, 237, 262, 258

(56) References Cited

U.S. PATENT DOCUMENTS 3,723,814 A * 3/1973 Gross ..... 361/45
5,170,139 A * 12/1992 Nelson ..... 333/103

* cited by examiner

*Primary Examiner*—Daniel Chang
(74) *Attorney, Agent, or Firm*—Fish & Richardson P.C.

(57) ABSTRACT

A balanced line switching apparatus that provides high isolation at an expense of a marginal increase of loss. Practical implementation can give as much as 40 dB isolation in a single stage.

11 Claims, 7 Drawing Sheets

FORWARD BIASED

REVERSED BIAS

HIGH ISOLATION SWITCH IN BALANCED LINES

BACKGROUND

This invention relates generally to microwave and millimeter wave (mm-wave) radio frequency (RF) circuits, and more particularly to achieving broadband high isolation switch in Balanced Line Circuits.

FIG. 1 shows a balanced line. A balanced line 10 may be achieved by using two conductors 11 and in a symmetric environment. Such balanced lines can be achieved for example as in twisted pair cable or on insulating substrates. The input port 12 is composed of two terminal 12*a* and 12*b*. Due to symmetry, terminals 12*a* and 12*b* have opposing voltage $V_1$ and $-V_1$ and support equal currents 16 and 17 in opposite direction or opposing current. In a balanced line configuration because there is no other path available for the current, the forward going current has to be equal to the reverse going current at any location, for example position 18, due to charge conservation. Moreover, voltage at any location 18 along the transmission line is also equal and opposite. If the balanced line is terminated in a balanced manner (i.e., same impedance on each line) using the output port terminal 13*a* and 13*b*, the output port 13 also has opposing voltages and currents, 14 and 15, respectively, at the terminal 13*a* and 13*b*.

Such balanced lines are widely used in substrates where ground is not easily accessible. Examples include silicon substrates without vias, which are widely used for both mm-wave and microwave frequencies.

Prior art electronic switches in balanced lines are achieved in series 20 and shunt 30 configuration, as shown in FIG. 2 and FIG. 3, respectively.

In FIG. 2, the input lines 22 and 23 have, in series, diodes 24 and 25, respectively. While diodes are depicted in this figure, in actual practice other devices that switch from a high impedance state (or blocking state) to a low impedance state (or transmitting state) may be used to perform the task. For example, the diodes could be replaced by a three terminal device, whose state is switched using one of the three terminals such as the base of a Bipolar Transistor, where the Emitter and Collector are the two ends of the switching device. In another configuration, the Emitter current is switched while the Base forms the input and the Collector the output. Considering FIG. 2, in the low impedance state when the diode is forward biased, the diodes 24 and 25 connect the input lines 22 and 23 to the output lines 26 and 27, respectively. The signal is thus transmitted in high strength. The S-parameter for the forward transmission gain, $S_{21}$, is high, being close to zero decibels (dB) S-parameters, or scattering parameters, are analogous to frequency response functions, but the terms are used at high and lower frequencies, respectively. In the other state the diodes are in the non-conducting state. In that state the signal is reflected back. Now the transmitted signal to the output lines 26 and 27 is attenuated and the $S_{21}$ transmission coefficient is low (−10's of dB), and is determined by the high impedance state. Since the high impedance is finite, a small amount of signal trickles through and is represented by $\delta_1$.

FIG. 3 shows a shunt mounted diode 30 in a balanced line for switch purposes. When the diode is reversed biased or is in the high impedance state, since it appears as open circuit between the lines, the signal is transmitted through or S21 is high, i.e., close to 0 dB. In the other state, diode 33 is forward biased and is in the low impedance state. In this state, because the input balanced lines 31 and 32 are effectively shorted by the small impedance, the voltage induced at the input of the balanced line 34 and 35 is effectively small. This then has very little signal transmitted to the out balanced lines 34 and 35.

In case of the series configuration 20, the impedance in the high impedance state determines the isolation. Since the impedance is finite but high impedance, a signal always leaks to the output. At mm-wave, the impedance in the high conducting state is mostly capacitive and could greatly reduce the isolation (or the magnitude of minus $S_{21}$, where $S_{21}$ is in dB). Similarly in the shunt configuration case the forward biased impedance or the low impedance state determines the isolation. Since the low impedance state has finite impedance (resistive at low frequency and reactive at mm-wave), the isolation is limited by this impedance.

SUMMARY

In an embodiment, a high isolation switch for a balanced line includes a switch connected in series between the input and output sections of each the two balanced line conductors and two switches cross connected between the input and output sections of the balanced line conductors. In an on-state, the series connected switches are in a low impedance state and the cross-connected switches are in a high impedance state. In an off-state, the series connected switches are in the high impedance state and the cross-connected switches are in the high impedance state, providing high isolation. The balanced line conductors and switches may be, e.g., diodes or bipolar junction transistors (BJTs), and may be integrated into a silicon substrate.

DETAILED DESCRIPTION

Figure 4:
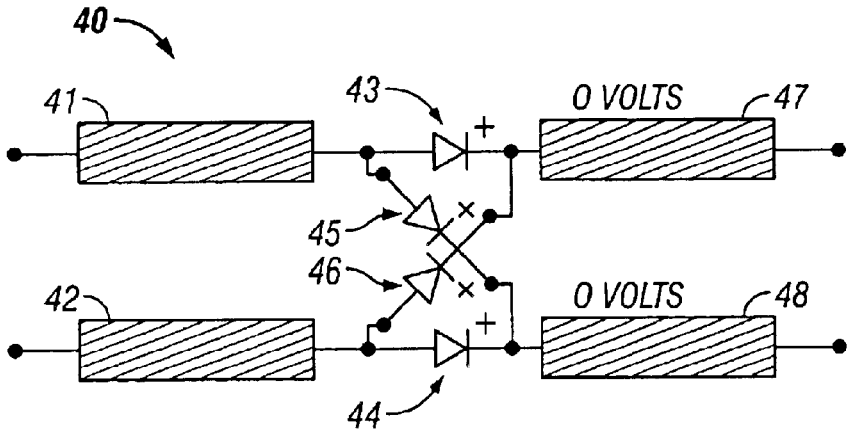
FIG. 4 shows a high isolation switch in balanced lines according to an implementation.

FIG. 4 shows a high isolation switch according to an implementation. Diodes 43 and 44 are series mounted diodes connecting the input balanced lines 41 to the output balanced line 47 and input balanced line 42 to the output balanced lines 48 respectively. In addition, a set of diodes 45 and 46 are cross mounted and biased in the high impedance state in both of the states of the switch. The diode 45 connects input balanced line 41 to output balanced line 48 and diode 46 connects input balanced line 42 to output balanced line 47 respectively. The cross connection is important for high isolation.

The switch in FIG. 4 has two states. In the on-state, the diodes 43 and 44 are in a low impedance state while diodes 45 and 46 are in a high impedance state. In this state, the signal in the input balanced line is directly coupled to the output balanced through the low impedance states of 43 and 44.

Figure 1:
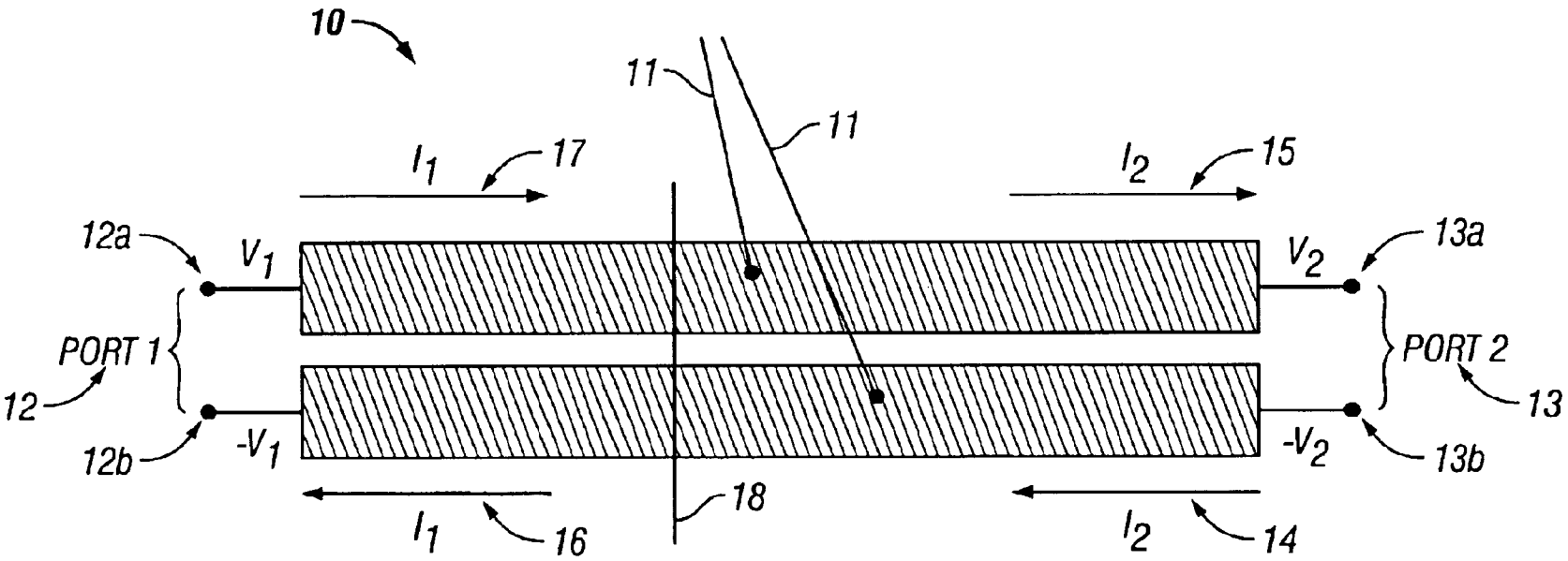
FIG. 1 is a schematic diagram of a balanced line.

In the off-state, the diodes 43 and 44 are in a high impedance state while diodes 45 and 46 are also in a high impedance state. In this state, since the balanced lines have opposing voltages on line 41 and 42 as described in connection with FIG. 1, the opposing voltages couple to output lines 47, 48 due to the two-diode cross-connections. Thus on line 47 a small signal (say $-\delta_3$) couples from diode 43 from the input line 41, while an opposing small signal (say $+\delta_3$) couples through diode 46 from the input line 42. Since 41 and 42 are in a balanced configuration, the voltage on each is negative of other provided that the diodes 43, 44, 45, 46 have the same high impedance in the non-conducting or reversed biased state. Since the circuit is electrically symmetric, that is, line 47 couples same amount of voltage from both of the input lines 41 and 42, exact cancellation occurs. As a result of this cancellation, isolation is theoretically infinite.

In real circuits there are number of reasons why the isolation degrades from the theoretical value. First of all, diodes are not the same due to process variance, nor is the bias exactly the same. This makes the off-state impedance different for the series and cross paths, thereby making the circuit asymmetric. Also, because of parasitic couplings, the isolation is limited by pad-to-pad and other couplings.

Figure 5A:
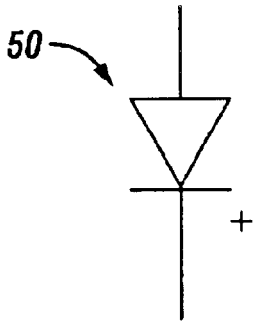
FIGS. 5A–5C show a simplified diode equivalent circuit in the forward biased state (low impedance state) and the reversed bias state (high impedance state).
Figure 5B:
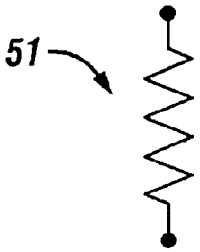
Figure 5C:
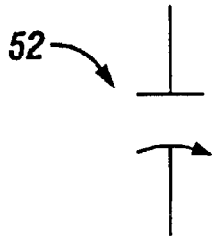

FIG. 5 shows a simplified equivalent circuit of a diode in the high impedance and the low impedance state. In the low impedance, or forward biased, state the diode can simply be represented by a forward bias resistance 51. In the high impedance state, or the reverse biased state, the diode can simply be represented by a capacitor 52. For example M/A-Com's diode MA4P165 (see http://www.macom.com/data/datasheet/pindiodeschip.pdf) has a forward bias resistance of less than 2.5-ohms at 10 mA forward bias and a capacitance of 0.05 pF at 10V reverse bias.

Figure 2:
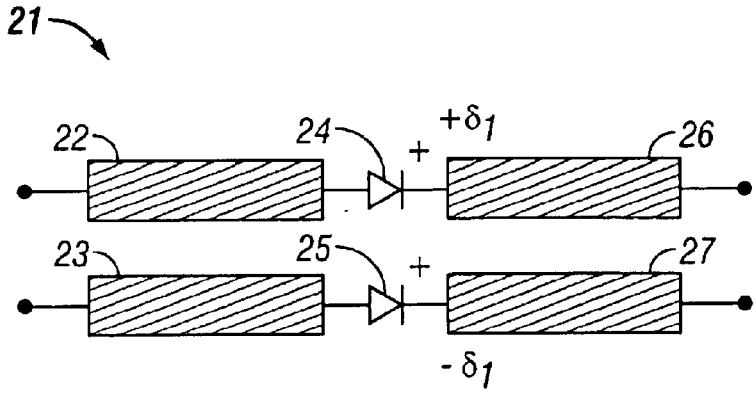
FIG. 2 (Prior Art)
FIG. 2 shows a prior art implementation of a series switch in balanced configuration.
Figure 3:
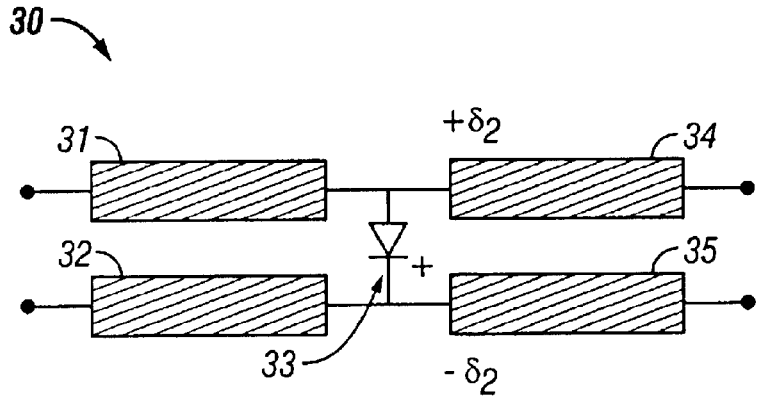
FIG. 3 (Prior Art)
FIG. 3 shows a prior art implementation of a series switch in balanced configuration.
Figure 6:
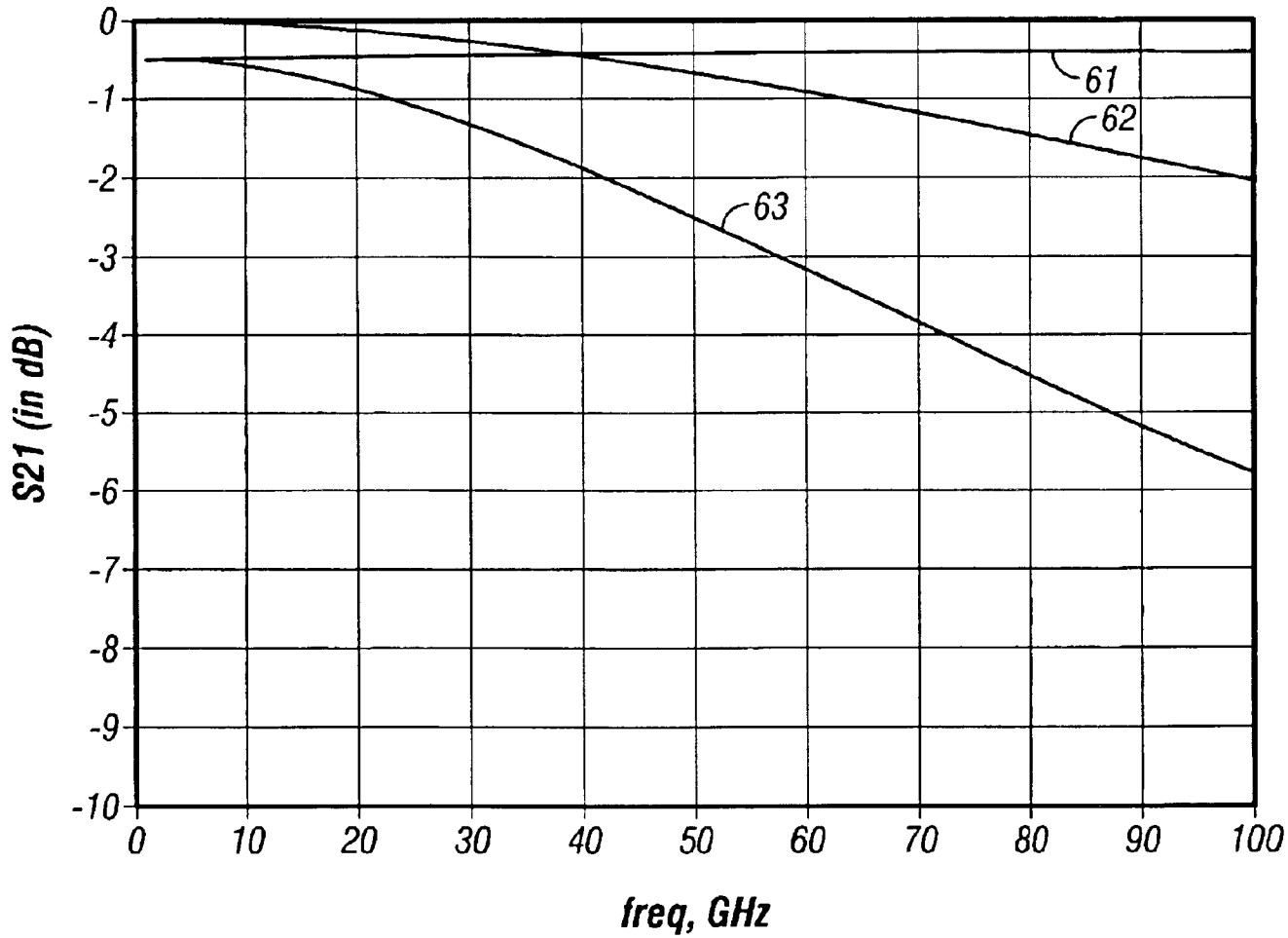
FIG. 6 shows simulated $S_{21}$ in the on-state for the series mounted configuration, shunt mounted configuration and the high isolation switch.

FIG. 6 shows a simulation of the switch in the on-state implement as shown in FIGS. 2, 3, and 4. For the simulation of the series configuration shown in FIG. 2, the diodes 24 and 25 are replaced by 2.5-ohms. Similarly for the simulation of the shunt configuration in FIG. 3, the diode 33 is replaced by capacitance of 0.05 pF. Moreover for simulation of the high isolation switch in FIG. 4, diodes 43 and 44 are replaced by 2.5-ohm resistor to represent the forward state and diodes 45 and 46 are replaced by 0.05 pF capacitance to represent the reversed bias states, respectively. In FIG. 6, 61 represents the insertion loss for the series configuration shown in FIG. 2, 62 represents the insertion loss with shunt configuration shown in FIG. 3, while 63 represents the insertion loss with the configuration in FIG. 4. At high frequency, the insertion loss of the series mounted diode is the best and the high isolation switch of FIG. 4 is the worst.

Figure 7:
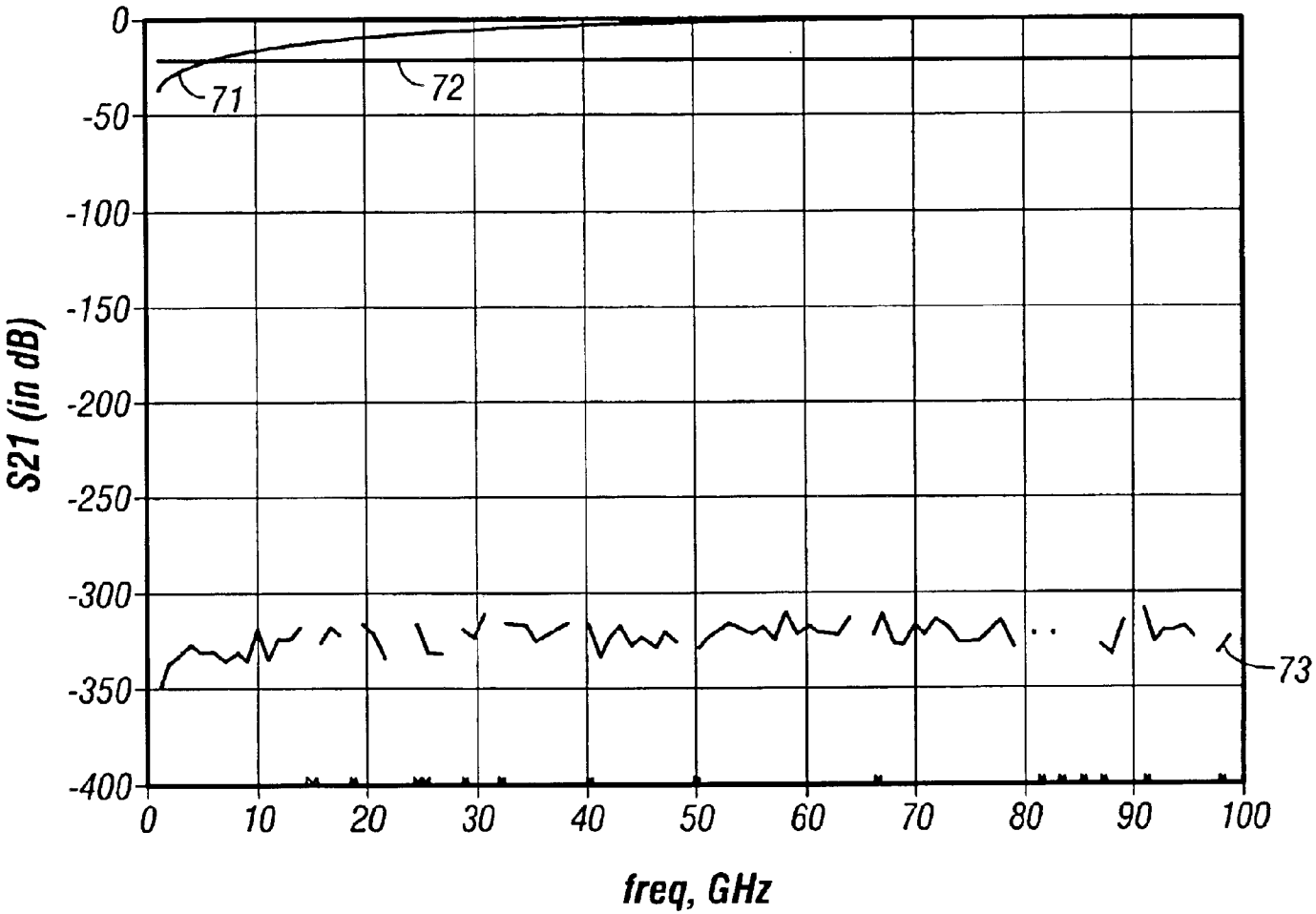
FIG. 7 shows simulated S21 in off-state for the series mounted configuration, shunt mounted configuration, and the high isolation switch.

FIG. 7 shows a simulation of the switches in FIGS. 2, 3, and 4, respectively, in the off-state. For the simulation of the series configuration shown in FIG. 2, the diodes 24 and 25 are replaced by 0.05 pF, while for the simulation of the shunt configuration in FIG. 3, the diode 33 is replaced by resistance of 2.5-ohm, and finally for simulation of the switch in FIG. 4, the diodes 43 and 44 are replaced by 0.05 pF capacitors to represent the reverse bias state and the diodes 45 and 46 are replaced by 0.05 pF capacitance to represent the reversed bias states, respectively. Notice that diodes 45 and 46 are not switched between the on-state and the off-state. In FIG. 7, curve 71 represents the isolation with series mounted diode, curve 72 represents the isolation with shunt mounted diode, while curve 73 represents the isolation loss with the switch in FIG. 4. At high frequency the isolation of the series mounted diode is the worst and the switch in FIG. 4 is the best. Theoretically, if the diodes are exactly matched and the circuit is symmetric, the cancellation of the coupled signal to the output is infinite as shown in FIG. 7.

This tremendous increase of isolation is the desired feature of this invention. Because of the increased isolation the switch can include a larger size diode, thereby reducing the insertion loss in the on-state of the switch. Often in a circuit the loss of the switch is not important. Through this new technique, extremely high isolation is possible in a very small space, is broadband and in a single stage.

Figure 8:
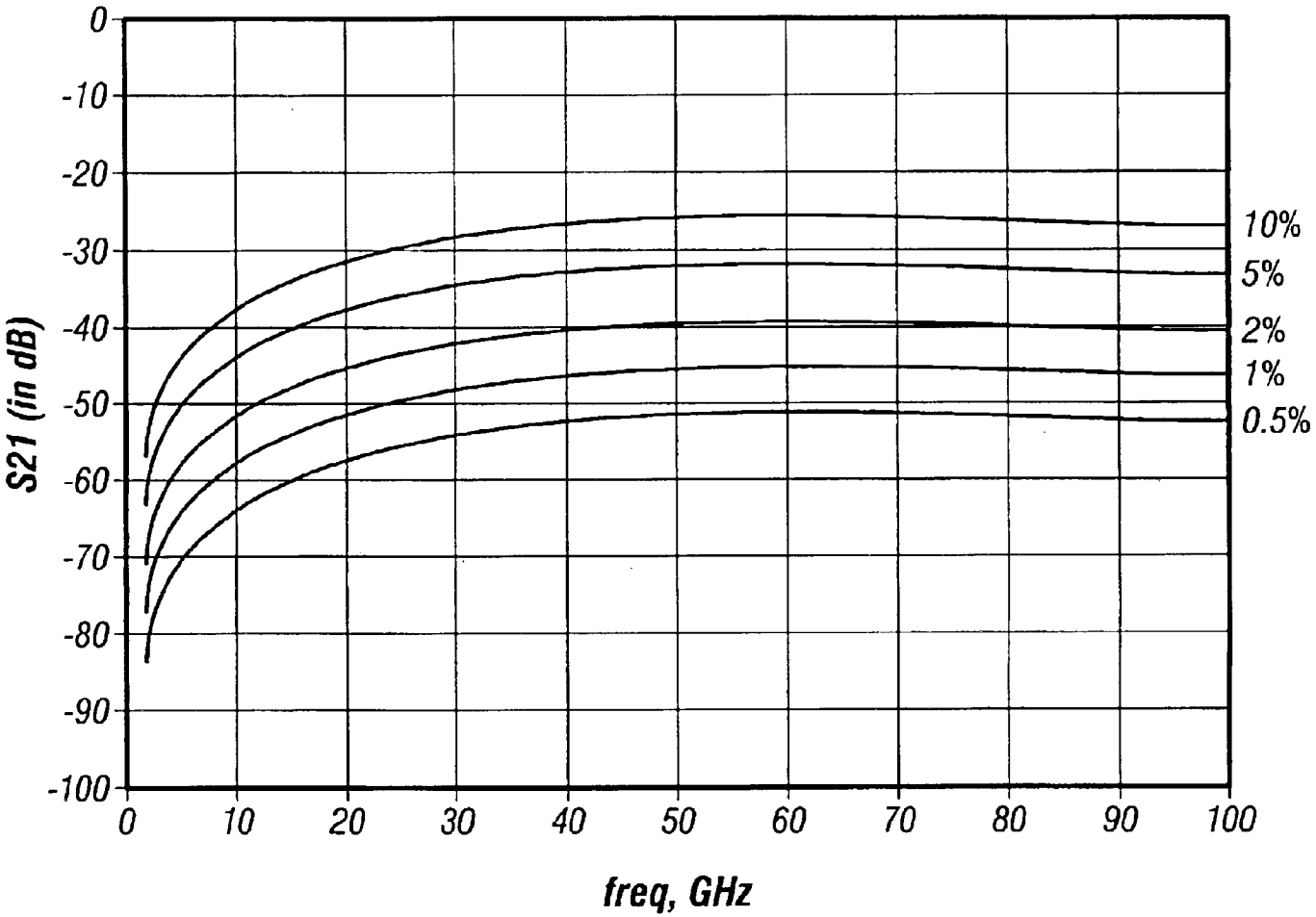
FIG. 8 shows simulated $S_{21}$ in the off-state for a configuration according to an implementation with the cross diodes up to 10% smaller than the series diode.

FIG. 8 provides a tolerance analysis of the isolation when the cross diodes are up to 10% lower than the series diode in capacitance. Even with 10% variance, substantial improvement in isolation is achieved. To reduce the effect of variance, the diode can be batch (or single wafer) processes and made in quad pair. Since the diodes would be close to each other and have similar variance, this diode-to-diode variance would not effect the isolation and one can expect substantial improvement in isolation.

Figure 9:
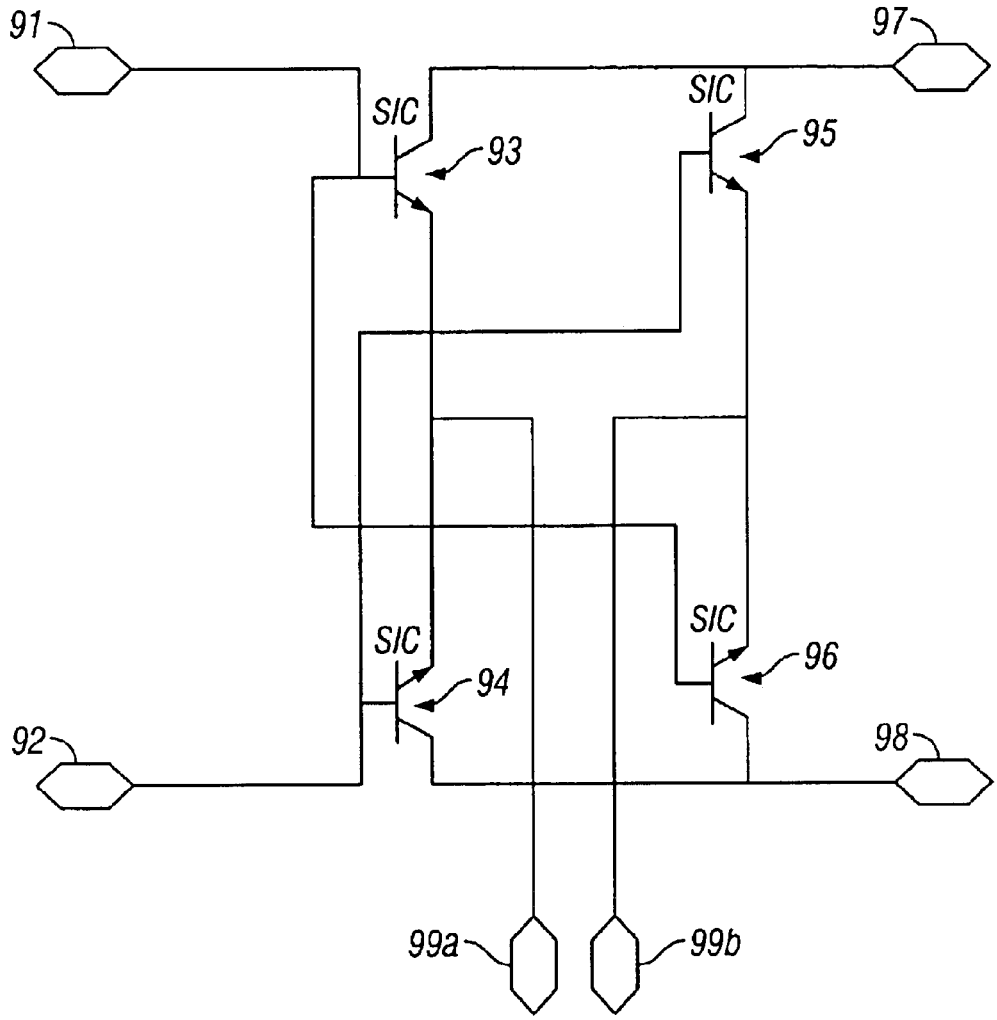
FIG. 9 shows an alternative implementation of the high-isolation switch using bipolar junction transistors (BJTs).

FIG. 9 shows an implementation of a high isolation switch circuit using a three terminal device. While bipolar junction transistor (BJT) is shown here, any other three or multi-terminal device is also usable. In the figure, 91 and 92 are the input balanced line, 93 and 94 are the series mounted transistors, and 96 and 95 are the cross-coupled transistors. The transistors 95 and 96 are biased through 99*b* and are always switched off, i.e., current through their collector is zero. The transistors 93 and 94 are biased through 99*a*. In the off-state 93 and 94 are biased in the off-state similar to 95 and 96, thereby the output signal at 97 and 98 are cancelled.

A number of embodiments have been described. Nevertheless, it will be understood that various modifications may be made without departing from the spirit and scope of the invention. For example, blocks in the flowcharts may be skipped or performed out of order and still produce desirable results. Accordingly, other embodiments are within the scope of the following claims.

What is claimed is:

1. A high isolation switch comprising:

a balanced line including:

a first conductor having an input section and an output section, and a second conductor having an input section and an output section;

a first switch connected in series between the input and output sections of the first conductor;

a second switch connected in series between the input and output section of the second conductor;

a third switch cross connected between the input section of the first conductor and the output section of the second conductor; and a fourth switch cross-connected between the input section of the second conductor and the output section of the first section, wherein an anode of the first switch and an anode of the third switch are connected at the input section of the first conductor, wherein an anode of the second switch and an anode of the forth switch are connected at the input section of the second conductor, wherein a cathode of the first switch and a cathode of the fourth switch are connected at the output section of the first conductor, and wherein a cathode of the second switch and a cathode of the third switch are connected at the output section of the second conductor.

2. The high isolation switch of claim 1, wherein each of the first, second, third, and fourth switches have a high impedance state and a low impedance state.

3. The high isolation switch of claim 1, wherein the conductors and switches are integrated on a silicon substrate.

4. The high isolation switch of claim 1, wherein the first, second, third and fourth switches comprise diodes.

5. The high isolation switch of claim 1, wherein the first, second, third and fourth switches comprise bipolar junction transistors.

6. The high isolation switch of claim 1, wherein the first, second, third and fourth switches comprises multi-terminal devices.

7. The high isolation switch of claim 1, wherein the first, second, third and fourth switches have substantially the same impedance in the high impedance state.

8. The high isolation switch of claim 1, wherein in the off-state, the voltages coupled on each of the output sections by the input sections of the first and second conductors substantially cancel.

9. A switch comprising:

a balanced line including:

a first conductor having an input section and an output section, and a second conductor having an input section and an output section;

a first switch connected in series between the input and output sections of the first conductor;

a second switch connected in series between the input and output section of the second conductor;

a third switch cross connected between the input section of the first conductor and the output section of the second conductor; and a fourth switch cross-connected between the input section of the second conductor and the output section of the first section, wherein the first and second switches are operative to switch between the high and low impedance states, and wherein the third and fourth switches are biased to stay in the high impedance state.

10. A high isolation switch comprising:

a balanced line including:

a first conductor having an input section and an output section, and a second conductor having an input section and an output section;

a first switch connected in series between the input and output sections of the first conductor;

a second switch connected in series between the input and output section of the second conductor;

a third switch cross connected between the input section of the first conductor and the output section of the second conductor; and a fourth switch cross-connected between the input section of the second conductor and the output section of the first section, wherein the first and second switches are operative to switch between the high and low impedance states, wherein the third and fourth switches are biased to stay in the high impedance state, wherein the high isolation switch has an on-state in which the first and second switches are in the low impedance state and the third and fourth switches are in the high impedance state, and wherein the high isolation switch has an off-state in which the first and second switches are in the high impedance state and the third and fourth switches are in the high impedance state.

11. A high isolation switch comprising:

a balanced line including:

a first conductor having an input section and an output section, and a second conductor having an input section and an output section;

a first switch connected in series between the input and output sections of the first conductor;

a second switch connected in series between the input and output section of the second conductor;

a third switch cross connected between the input section of the first conductor and the output section of the second conductor; and a fourth switch cross-connected between the input section of the second conductor and the output section of the first section, and wherein the high isolation switch is operative to provide high isolation over a broadband range of frequencies.

* * * * *